US006302994B1

(12) United States Patent
Kamiya et al.

(10) Patent No.: US 6,302,994 B1
(45) Date of Patent: Oct. 16, 2001

(54) PROCESS FOR PRODUCING LABELED ARTICLE

(75) Inventors: Daisuke Kamiya; Kiyokazu Mizutani; Yoichi Kirito; Akemi Koketsu; Makoto Niwa; Kotaro Yoneda; Hiroshi Iesako; Hitoshi Kato, all of Nagoya (JP)

(73) Assignee: Toagosei Co., Ltd., Tokyo (JP)

( * ) Notice: Subject to any disclaimer, the term of this patent is extended or adjusted under 35 U.S.C. 154(b) by 0 days.

(21) Appl. No.: 09/242,098

(22) PCT Filed: Jun. 18, 1998

(86) PCT No.: PCT/JP98/02705

§ 371 Date: Feb. 8, 1999

§ 102(e) Date: Feb. 8, 1999

(87) PCT Pub. No.: WO98/58034

PCT Pub. Date: Dec. 23, 1998

(30) Foreign Application Priority Data

Jun. 18, 1997 (JP) ..... 9-178994
Jun. 18, 1997 (JP) ..... 9-178996

(51) Int. Cl.[7] ..... B65C 11/06
(52) U.S. Cl. ..... 156/320; 156/324.4; 524/501
(58) Field of Search ..... 156/320, 324.4; 524/501

(56) References Cited

U.S. PATENT DOCUMENTS 4,420,583 * 12/1983 Hutton ..... 524/501
4,427,744 * 1/1984 Hume ..... 156/320

FOREIGN PATENT DOCUMENTS 0 574 803 A2 12/1993 (EP) .
5-117612 5/1993 (JP) .
5-230427 9/1993 (JP) .

* cited by examiner

*Primary Examiner*—John J. Gallagher
(74) *Attorney, Agent, or Firm*—Browdy and Neimark

(57) ABSTRACT

A process for producing an article with a label, which comprises attaching, to an article, a heat-sensitive and pressure-sensitive adhesive label having an adhesive layer composed of a pressure-sensitive adhesive composition, which is an aqueous emulsion type composition comprising:

(A) a water-soluble resin obtained by neutralizing a resin having an acid value of 1 meq/g or more, with a base, and (B) a polymer having an acid value of 0.6 meq/g or less and a glass transition temperature of −20° C. or lower, obtained by emulsion polymerization of a radical-polymerizable monomer, and which, when made into an aqueous film and dried at a temperature lower than 60° C., becomes a film (1) of two-phase structure wherein particles composed of the component (B) are dispersed in a continuous phase composed of the component (A) and, when the film (1) is heated to a temperature of 60° C. or higher, is converted into a pressure-sensitive adhesive film (2) wherein the forms of the component (A) and the component (B) in the above two-phase structure are reversed and particles of the component (A) are dispersed in a continuous phase of the component (B).

4 Claims, No Drawings

PROCESS FOR PRODUCING LABELED ARTICLE

TECHNICAL FIELD

The present invention relates to a process for producing an article with a label, which article comprises an adhered and a pressure-sensitive adhesive label attached thereto and in which article the pressure-sensitive adhesive label can be easily peeled from the adhered by contacting the bonded area with an aqueous alkali solution. In the article with a label according to the present invention, the adhesive layer of the pressure-sensitive adhesive label attached to the adhered has excellent water resistance and adhesion strength.

BACKGROUND ART

Labels to be attached to bottles for drinks (e.g. bottle for beer) are required to have a high adhesion strength to an article (e.g. bottle) and, after having been attached to an article (e.g. bottle), are required to have high water resistance when immersed in water and a property that they are peeled from the article in a short time when washed with an aqueous alkali solution (the property is hereinafter referred to as "alkali peelability").

As the adhesives used in such labels, there have been used starch-based adhesives, casein-based adhesives, polyvinyl alcohol-based adhesives, etc.; that is, "cold glues", etc.

In attaching a label to an article using a cold glue, a method is ordinarily adopted in which an adhesive is coated on the back side of a label and immediately the label is attached to an article. Therefore, in order to conduct this attaching operation continuously at a high speed, it is necessary to conduct two kinds of operations, namely, coating of an adhesive and attaching of a label mechanically. A machine having such functions is expensive and has been used only in limited fields.

Cold glues have had another problem. That is, cold glues ordinarily contain a slight amount of water for viscosity adjustment; when a cold glue is applied to a paper label and the label is attached to an article, the water in cold glue infiltrates into the label, inviting the curling (warpage) of the label.

Meanwhile, it was investigated to use, in applications where alkali peelability of a label is required, a pressure-sensitive adhesive having higher alkali solubility or swellability, obtained by slightly modifying the structure of the acrylic acid ester copolymer widely used as a conventional pressure-sensitive adhesive. In pressure-sensitive adhesives of acrylic acid ester copolymer type, however, the alkali peelability is insufficient in many cases; increase in alkali peelability results in reduced water resistance; when a beer bottle or the like to which a label using such a pressure-sensitive adhesive has been attached, is placed in water, the label tends to peel off.

The present invention is intended to provide a process for producing an article with a label satisfying that the label is attached to the article as an adhered with an adhesive layer having excellent resistance to ordinary water (e.g. tap water) and the label is easily peeled from the adhered by washing with an aqueous alkali solution.

DISCLOSURE OF THE INVENTION

The present inventors made a keen study to achieve the above task. As a result, the present invention has been completed.

The present invention lies in a process for producing an article with a label, which comprises attaching, to an article, a heat-sensitive and pressure-sensitive adhesive label having an adhesive layer composed of a pressure-sensitive adhesive composition, which is an aqueous emulsion type composition comprising:

(A) a water-soluble resin obtained by neutralizing a resin having an acid value of 1 meq/g or more, with a base, and (B) a polymer having an acid value of 0.6 meq/g or less and a glass transition temperature of −20° C. or lower, obtained by emulsion polymerization of a radical-polymerizable monomer, and which, when made into an aqueous film and dried at a temperature lower than 60° C., becomes a film (1) of two-phase structure wherein particles composed of the component (B) are dispersed in a continuous phase composed of the component (A) and, when the film (1) is heated to a temperature of 60° C. or higher, is converted into a pressure-sensitive adhesive film (2) wherein the forms of the component (A) and the component (B) in the above two-phase structure are reversed and particles of the component (A) are dispersed in a continuous phase of the component (B).

DETAILED DESCRIPTION OF THE INVENTION

The present invention is hereinafter described in detail. In the following, acrylic and/or methacrylic is referred to as "(meth)acrylic" and acrylate and/or methacrylate is referred to as "(meth)acrylate".

In the present invention, "glass transition temperature " (hereinafter referred to as "Tg") of a polymer is a value determined from the following calculation formula (1). The Tg in the calculation formula (1) is an absolute temperature (unit: ° K.), but the Tg in the other parts of the present description is a Celsius temperature (unit: ° C.).

$$1/Tg=W(a)/Tg(a)+W(b)/Tg(b)+W(c)/Tg(c)+ \quad (1)$$

wherein Tg=Tg (K) of a polymer,

W(a)=weight fraction of structural units composed of monomer (a) in the polymer, W(b)=weight fraction of structural units composed of monomer (b) in the polymer, W(c)=weight fraction of structural units composed of monomer (c) in the polymer, Tg(a)=glass transition temperature (K) of homopolymer of monomer (a), Tg(b)=glass transition temperature (K) of homopolymer of monomer (b), Tg(c)=glass transition temperature (K) of homopolymer of monomer (c), ○ Component (A)

The component (A) used in the present invention is a water-soluble resin and is obtained by neutralizing a resin having an acid value of 1 meq/g or more with a base.

The acid value of the unneutralized resin used for production of the component (A) (the acid value is hereinafter referred to as "acid value of unneutralized resin") is preferably 1 to 5 meq/g. When the acid value is less than 1 meq/g, the component (A) has insufficient alkali solubility or insufficient alkali swellability and is unable to provide a pressure-sensitive adhesive label having sufficient alkali peelability. Meanwhile, when the acid value of the component (A) is more than 5 meq/g, the resulting pressure-sensitive adhesive layer has insufficient water resistance in some cases.

As the method for obtaining the pressure-sensitive adhesive composition of the present invention, there can be mentioned, for example, a method of mixing the component (A) and the component (B) which have been produced independently, and a method of producing the component (B) by emulsion polymerization in the presence of the component (A). The latter method is preferred from the reason that an adhesive layer having excellent water resistance can be formed.

As the monomer units constituting the component (A), there are preferred an α,β-ethylenically unsaturated carboxylic acid monomer unit and a hydro-phobic radical-polymerizable monomer unit. The component (A) may be a straight chain random copolymer, but is preferred to be a graft copolymer wherein either of a hydrophobic polymer and a hydrophilic polymer forms branches and the other is a backbone. When the component (A) is a graft copolymer, the hydrophobic polymer in the graft copolymer has high affinity with the component (B) (to be described later), and therefore, a pressure-sensitive adhesive composition having excellent emulsion stability can be obtained. In a preferred graft copolymer, the hydrophilic polymer moiety has a Tg of 30 to 130° C. and the hydrophobic polymer moiety has a Tg of −20° C. or lower. Such a graft copolymer can be obtained by copolymerizing a macromonomer having a hydrophilic polymer skeleton, with another radical-polymerizable monomer, or by copolymerizing a macromo-nomer having a hydrophobic polymer skeleton, with another radical-polymerizable monomer.

Description is made first on the water-soluble straight chain random copolymer used as the component (A). The copolymer is preferably a copolymer composed of the above-mentioned monomers, having a Tg of 20° C. or higher.

As specific examples of the α,β-ethylenically unsaturated carboxylic acid, there can be mentioned acrylic acid, methacrylic acid, crotonic acid, maleic acid, fumaric acid, itaconic acid, citraconic acid and maleic anhydride. These monomers can be used singly or in combination of two or more. The amount of the α,β-ethylenically unsaturated carboxylic acid capable of allowing the resulting resin to have an acid value mentioned above differs depending upon the kind of the unsaturated carboxylic acid used, but is ordinarily about 3 to 40% by weight based on the weight of the total monomers used for synthesizing the component (A).

The hydrophobic radical-polymerizable monomer used in combination with the α,β-ethylenically unsaturated carboxylic acid preferably has a water solubility of 2 g or less per 100 g of water. Specifically, the following monomers can be mentioned.

That is, there are cited alkyl (meth)acrylates such as methyl (meth)acrylate, ethyl (meth)acrylate, isopropyl (meth)acrylate, n-propyl (meth)acrylate, n-butyl (meth) acrylate, isobutyl (meth)acrylate, hexyl (meth)acrylate, cyclohexyl (meth)acrylate, 2-ethylhexyl (meth)acrylate, n-octyl (meth)acrylate, isooctyl (meth)-acrylate, n-nonyl (meth)acrylate, isononyl (meth)acrylate and the like; vinyl aromatic monomers such as styrene, c-methylstyrene, vinyltoluene and the like; olefin monomers such as propylene, butylene, isobutylene, pentene and the like; and so forth. These monomers are used in an amount of preferably 30 to 97% by weight based on the weight of the total monomers used in synthesis of the component (A).

It is possible to use, as the monomer for production of the water-soluble straight chain random copolymer, a hydrophilic radical-polymerizable monomer other than the α,β-ethylenically unsaturated carboxylic acid in combination, in an amount of 0 to 40% by weight.

As such a hydrophilic radical-polymerizable monomer, there can be mentioned methyl acrylate, vinyl acetate, acrylonitrile, 2-hydroxyethyl (meth)acrylate, 2-hydroxypropyl (meth)acrylate, polyethylene glycol mono (meth)acrylate, polypropylene glycol mono(meth)-acrylate, (meth)acrylamide, N-methylolacrylamide, glycidyl methacrylate, styrenesulfonic acid and sodium salt thereof, 2-acrylamido-2-methylpropanesulfonic acid and sodium salt thereof, etc.

The aqueous graft copolymer used as the component (A) can be produced by copolymerizing the above-mentioned macromonomer with the above-mentioned monomer, etc. As well known, the macromonomer constitutes the branch polymer of the graft copolymer obtained. The number-average molecular weight of the macromonomer is preferably 1,000 to 30,000, more preferably 2,000 to 20,000.

The proportions of the macromonomer and the other monomer copolymerized are preferably 10 to 70% by weight (the macromonomer) and 30 to 90% by weight (the other monomer).

As specific examples of the macromonomer, there can be mentioned a polymethyl methacrylate type macromonomer (a polymethyl methacrylate having a methacryloyl group at one end), a polybutyl acrylate type macromonomer (a polybutyl acrylate having a methacryloyl group at one end) and a poly-2-ethylhexyl acrylate type macromonomer (a poly-2-ethylhexyl acrylate having a methacryloyl group at one end).

When the above macromonomer is used, the resulting graft copolymer has a hydrophobic polymer as the branch component; therefore, the monomer to form a backbone polymer, i.e. the monomer to be copolymerized with the macromonomer must be selected so that it can form a hydrophilic polymer.

The component (A) composed of the water-soluble straight chain random copolymer or the aqueous graft copolymer can be produced by neutralizing a copolymer obtained by polymerizing the above-mentioned monomers with a base, or by copolymerizing a neutralization product of the α,β-ethylenically unsaturated carboxylic acid with a base, i.e. a salt monomer with the above-mentioned other monomer or macromonomer.

The polymerization process for producing the water-soluble straight chain random copolymer or the aqueous graft copolymer includes solution polymerization, bulk polymerization, suspension polymerization, emulsion polymerization, precipitation polymerization, etc. Solution polymerization and emulsion polymerization are preferred. The polymerization is initiated preferably by use of a radical polymerization initiator, because the use ensures easy polymerization operation, easy control of molecular weight of the unneutralized copolymer obtained, etc.

The organic solvent usable in the solution polymerization is preferably at least one organic solvent selected from ketone types, acetic acid ester types, aromatic hydrocarbon types, aliphatic hydrocarbon types, alcohol types, etc. The organic solvent is more preferably methyl ethyl ketone and/or isopropyl alcohol.

As the polymerization initiator, there can be mentioned persulfate type polymerization initiators, azo type polymerization initiators, redox type polymerization initiators, etc. The amount of the polymerization initiator used is preferably 0.1 to 5% by weight based on the total weight of the monomers.

Production of the component (A) by emulsion polymerization can be conducted, for example, as follows. The above-mentioned radical-polymerizable monomer and an emulsifier are mixed and dispersed in water to form a monomer emulsion; the emulsion is continuously fed into a reactor together with an appropriate radical polymerization initiator to conduct polymerization; thereby, the component (A) can be smoothly obtained (this process is disclosed in J-A-6-271779).

The polymerization temperature is preferably 60 to 100° C. The polymerization time is preferably 3 to 10 hours.

The number-average molecular weight of the component (A) obtained by the above polymerization is preferably 1,000 to 50,000. When the number-average molecular weight of the polymer obtained is smaller than 1,000, the adhesive layer (produced using the polymer) of pressure-sensitive adhesive label adhering to an adhered tends to have insufficient water resistance. Meanwhile, when the number-average molecular weight of the polymer is larger than 50,000, the polymer has too high a viscosity; therefore, when the pressure-sensitive adhesive produced using the polymer is made into a film and dried and the dried film is heated to 60° C. or higher, the conversion in film, of the continuous phase (composed of the polymer) into particles does not take place smoothly.

The base used for production of the component (A) includes ammonia; amines such as alkylamine, allylamine, alkanolamine and the like; alkali metal hydroxides such as sodium hydroxide, potassium hydroxide and the like; salts of alkaline earth metals such as magnesium, calcium and the like; and so forth. The base is preferably ammonia, methylamine, ethylamine, propylamine, isopropylamine or the like, all having a boiling point of 110° C. or lower. Ammonia is preferred particularly. When ammonia is used as the base for neutralization, it is easily removed from the adhesive layer in the drying step after coating, making it possible to obtain an adhesive layer having excellent water resistance.

In the present invention, the component (A) may not be completely neutralized, but must be neutralized at least in such a degree that the component (A) is water-soluble. That is, the acidic groups in unneutralized polymer are neutralized in an amount of preferably 30 mole % or more, more preferably 50 mole % or more.

A rosin derivative may be used as the component (A). There can be used, for example, a resin obtained by modifying a rosin or a hydrogenated rosin with a dibasic acid anhydride such as maleic anhydride, phthalic anhydride or the like and then neutralizing the modified resin with a base.

As the organic acid-modified rosin, there can be used commercial products, for example, HARIMACK T-80 (trade name, a product of Harima Chemicals, Inc.) and PENTALYN 255 (trade name, a product of RIKA Hercules Inc.)

○ Component (B)

The component (B) used in the present invention is a polymer which is obtained by emulsion-polymerizing a radical-polymerizable monomer and which has an acid value of 0.6 meq/g or less and a Tg of −20° C. or lower, and has a role of imparting adhesive strength (tackiness) to the pressure-sensitive adhesive composition of the present invention.

The acid value of the component (B) is preferably 0.1 meq/g or less, more preferably 0.03 meq/g or less. With a polymer having an acid value of more than 0.6 meq/g, the resulting adhesive layer has insufficient water resistance.

The Tg of the component (B) is preferably −50° C. or lower. With a polymer having a Tg of higher than −20° C., the resulting adhesive layer has insufficient adhesive strength (tackiness) and, moreover, when immersed in, for example, an aqueous alkali solution, may have low alkali peelability because infiltration of the alkali solution into the adhesive layer is difficult.

The component (B) is obtained by emulsion polymerization of a radical-polymerizable monomer. The monomer used in emulsion polymerization must be selected so that the resulting polymer has an acid value and a Tg falling in the respective ranges mentioned above.

The monomer usable in production of the component (B) includes ethylene; conjugated vinyl monomers such as butadiene, isoprene, chloroprene, isobutylene and the like; vinyl esters such as vinyl acetate, vinyl propionate, vinyl butyrate, vinyl pivalate, vinyl laurate, vinyl versatate and the like; alkyl (meth)acrylates such as methyl (meth)acrylate, ethyl (meth)acrylate, isopropyl (meth)acrylate, n-propyl (meth)acrylate, n-butyl (meth)acrylate, isobutyl (meth) acrylate, hexyl (meth)acrylate, cyclohexyl (meth)acrylate, 2-ethylhexyl (meth)acrylate, n-octyl (meth)acrylate, isooctyl (meth)acrylate, n-nonyl (meth)acrylate, isononyl (meth) acrylate, decyl (meth)acrylate, lauryl (meth)acrylate and the like; aromatic vinyl monomers such as styrene, a-methylstyrene, vinyltoluene and the like; unsaturated carboxylic acids such as (meth)acrylic acid, crotonic acid, cinnamic acid, itaconic acid, fumaric acid, maleic acid and the like; monoalkyl esters of unsaturated dicarboxylic acids, such as monoethyl itaconate, monobutyl fumarate, monobutyl maleate and the like; hydroxyl group-containing vinyl monomers such as 2-hydroxyethyl (meth)acrylate, 2-hydroxypropyl (meth)acrylate, polyethylene glycol mono (meth)acrylate, polypropylene glycol mono(meth)acrylate and the like; (meth)acrylonitrile; (meth)acrylamide; N-methylolacrylamide; glycidyl methacrylate; vinyl chloride; vinylidene chloride; and so forth. Preferably, these monomers are used in combination of two or more.

The component (B) must have tackiness. Therefore, the monomer units constituting the component (B) are substantially the same as those of the polymers ordinarily used as a pressure-sensitive adhesive. Hence, desired monomers can be selected from the above-mentioned monomers with reference to the constitution of the polymers used in conventional pressure-sensitive adhesives.

Preferred monomers are, for example, a monomer mixture consisting mainly of an alkyl (meth)acrylate, a monomer mixture consisting mainly of ethylene and a vinyl ester, and a monomer mixture consisting mainly of a conjugated vinyl monomer.

An example of the process for obtaining the component (B) is ordinary emulsion polymerization using a known surfactant as the emulsifier. As the surfactant usable herein, there can be mentioned anionic surfactants such as sodium salt of higher alcohol sulfate, sodium alkylbenzenesulfonate, sodium salt of dialkyl succinate sulfonic acid, sodium salt of alkyl diphenyl ether disulfonic acid, and the like; and nonionic surfactants such as polyoxyethylene alkyl allyl ether, polyoxyethylene polyoxypropylene block copolymer and the like.

In emulsion polymerization of the above-mentioned monomers for obtaining the component (B), the component (A) may be used as the emulsifier. By this approach, the pressure-sensitive adhesive composition used in the present invention can be obtained at the same time at which the component (B) is obtained. In this emulsion polymerization, it is possible to use, as the emulsifier, the above-mentioned surfactant used ordinarily, in combination with the component (A).

The pressure-sensitive adhesive composition obtained by producing the component (B) by emulsion polymerization using the component (A) as the emulsifier, can form an adhesive layer having excellent water resistance.

As the polymerization initiator used in the emulsion polymerization for obtaining the component (B), there can be used the exemplary compounds mentioned for the radical polymerization initiator used for obtaining the polymer (A). The amount of the polymerization initiator used is preferably 0.1 to 5% by weight based on the total amount of the monomers.

○ Pressure-sensitive adhesive composition

The pressure-sensitive adhesive composition used in the present invention is an aqueous emulsion comprising the component (A) and the component (B). It can be obtained by simple mixing of the component (A) and the component (B), or by emulsion-polymerizing the monomers necessary for obtaining the component (B), in the presence of the component (A). The pressure-sensitive adhesive composition has a solid content of preferably 30 to 70% by weight.

The weight ratio of the component (A) and the component (B) are preferably component (A)/component (B)=5/95 to 50/50, more preferably component (A)/component (B)=10/90 to 40/60.

When the proportion of the component (A) is less than 5% by weight based on the total weight of the component (A) and the component (B), the resulting adhesive layer may have insufficient alkali peelability. Meanwhile, when the proportion of the component (A) is more than 50% by weight, the adhesive layer tends to have low water resistance.

The pressure-sensitive adhesive composition used in the present invention is an aqueous emulsion wherein the polymer fine particles resulting from the component (B) are surrounded by the component (A), that is, fine particles are dispersed in an aqueous medium. This emulsion has the following property. When the emulsion is coated on a base material such as film or the like to form a water-containing thin film and the film is dried at a temperature lower than 60° C., a film (1) of two-phase structure is obtained wherein the particles composed of the component (B) are dispersed in a continuous phase composed of the component (A); and when the film is heated to a temperature of 60° C. or higher, the forms of the component (A) and the component (B) in the two-phase structure are reversed and the film is converted into a pressure-sensitive adhesive film (2) wherein the particles of the component (A) are dispersed in a continuous phase of the component (B).

In the present invention, it is preferred to use a pressure-sensitive adhesive composition satisfying that the film (1) has a surface adhesive strength of 10 g/25 mm or less as measured at 23° C. by the 180° peeling method specified by JIS Z 0237 and the film (2) has a surface adhesive strength of 100 g/25 mm or more as measured by the same method. When the film (1) formed by low-temperature drying has a surface adhesive strength of 10 g/25 mm or less, the film (1) shows substantially no tackiness at ordinary temperature owing to the extremely low adhesive strength. Therefore, in a pressure-sensitive adhesive label obtained from a pressure-sensitive adhesive composition having such a property, an operation such as attaching a release paper to the pressure-sensitive adhesive side of the label can be omitted.

The above-mentioned thermal property of the present pressure-sensitive adhesive composition is developed by adopting the component (A) and the component (B) each constituted as mentioned above. That the aqueous resin composition comprising the component (A) and the component (B) has the above-mentioned thermal property, has been unknown heretofore. The present inventors found out that the resin film composed of said composition has no tackiness when dried at ordinary temperature but develops tackiness when dried at a temperature higher than 60° C., and confirmed, by use of an electron microscope, the form of the micro-phase-separation of the two components in each case.

When a label coated with the above pressure-sensitive adhesive composition has been attached to an article such as bottle for beer, plastic bottle or the like, the components (A) and (B) are present in the adhesive layer of the label, in a state that the particles of the component (A) are dispersed in a continuous phase of the component (B). Since the adhesive layer is in such a state, the adhesive exhibits excellent water resistance and adhesive strength. Meanwhile, it is not clear why the above adhesive layer has excellent alkali peelability as compared with conventional adhesive layers obtained with conventional pressure-sensitive adhesives; however, it is presumed that the component (A) of particulate form having alkali solubility or swellability has excellent alkali peelability as compared with when the component (A) is in a continuous phase of a polymer with a functional group having alkali solubility or swellability.

The pressure-sensitive adhesive composition of the present invention may, as necessary, contain an anti-foaming agent, a surfactant, a fungicide, a perfume, a tackifier, a thickener, a leveling-controlling agent, an anti-freeze agent, a foaming agent, an anti-oxidant, a ultraviolet absorber, a filler, a pigment, a fluorescent whitening agent, an anti-blocking agent, a flame retardant, a crosslinking agent, a plasticizer, a lubricant, an organic solvent, etc., all generally used in ordinary pressure-sensitive adhesives.

There is no particular restriction as to the base material for a label on which the present pressure-sensitive adhesive composition is coated. As the base material, there can be mentioned, for example, films or sheets made of a cloth, a paper, a leather, a wood, a metal, a glass, a plastic or the like; boards; and foamed plastic sheets. As the base material made of a plastic, there can be mentioned base materials made of a polyester, a polyamide, a vinyl chloride polymer, a polyethylene, a polypropylene, a polyurethane or the like. The shape of the base material may be any of a continuous long shape, various shapes formed by cutting (e.g. rectangular, circular and oval), etc.

The coating of the pressure-sensitive adhesive composition can be conducted by an appropriate method such as roll coater coating, spray coating, cast coating, doctor blade coating, brush coating or the like.

The pressure-sensitive adhesive layer formed by the coating is dried. The drying must be conducted at a temperature lower than 60° C. The resulting dried pressure-sensitive adhesive film has low tackiness or nontackiness to the extent that substantially no tackiness is felt when the film is touched by hand.

In the present invention, the label with a pressure-sensitive adhesive layer having the above-mentioned low tackiness or nontackiness is heated once to about 60 to 140° C. and then attached to an article (an adherend), whereby an article with a label according to the present invention can be obtained.

As the article to which a label is attached, there can be mentioned, for example, bottles for beer; plastic-, paper- or metal-made bottles; household electric appliances and parts therefor; window glasses; construction materials such as aluminum sash, plate and the like; corrugated cardboard boxes; packaging materials such as polymer bag, wrapping paper and the like; and automobile body and interior finishing materials.

In the thus-obtained article with a label, the label and the article are bonded with a high adhesion strength; moreover, when the label is needed to be peeled, the label can be easily peeled by contacting the adhesive layer with an aqueous alkali solution. This easy peeling of a label from an article makes it possible to decrease the cycling cost of recovery, washing and reuse of, for example, beer bottles and resultantly increase the frequency in use of glass bottles which are suited for protection of global environment as compared with metallic cans of resource waste type.

The aqueous alkali solution used as a washing water includes, for example, an aqueous solution containing about 2 to 3% by weight of sodium hydroxide. Preferably, the solution is used under warning at 40 to 80° C. for efficient washing.

BEST MODE FOR CARRYING OUT THE INVENTION

The present invention is described more specifically below by way of Examples and Comparative Examples. In each of the following Examples and Comparative Examples, "parts" and "%" refer to "parts by weight" and "% by weight", respectively.

The details of the abbreviated forms used in the following are shown in Table 1. Also in Table 1 are shown the Tg values of the homopolymers of individual monomers.

TABLE 1

| Abbreviated form | Compound | Tg (° C.) |
|---|---|---|
| MMA | Methyl methacrylate | 105 |
| HEMA | 2-Hydroxyethyl methacrylate | 55 |
| MAA | Methacrylic acid | 130 |
| AA | Acrylic acid | 105 |
| HA | 2-Ethylhexyl acrylate | −85 |
| BA | Butyl acrylate | −54 |
| ST | Styrene | 100 |
| EL | Ethylene | −125 |
| VAC | Vinyl acetate | 30 |
| HEA | 2-Hydroxyethyl acrylate | −15 |
| AIBN | 2,2'-Azobisisobutyronitrile | |
| APS | Ammonium persulfate | |
| DM | Dodecylmercaptan | |
| TGO | Octyl thioglycolate | |

EXAMPLES OF SYNTHESIS OF PRESSURE-SENSITIVE ADHESIVE COMPONENTS

○ Synthesis of component (A)

Synthesis Example 1

1.5 parts of AIBN as a polymerization initiator was dissolved in a mixed solution consisting of 80 parts of MMA, 10 parts of ST, 10 parts of AA (these are monomers), 3.5 parts of dodecylmercaptan as a chain transfer agent and 100 parts of methyl ethyl ketone as an organic solvent. The resulting solution was fed into a flask provided with a stirrer, a condenser, a thermometer and a nitrogen-inlet tube, and heated at 80° C. for 4 hours in a nitrogen atmosphere to give rise to polymerization. Thereto was added a further 0.5 part of AIBN, followed by heating at the same temperature for 5 hours to obtain a methyl ethyl ketone solution of a copolymer (acid value: 1.4 meq/g), having a solid content of 50%.

To 200 parts of the methyl ethyl ketone solution of the copolymer was gradually added ammonia water with stirring, to neutralize the carboxyl groups of the copolymer and make the pH of the reaction mixture about 7 to 8. Then, methyl ethyl ketone was removed at 50° C. under reduced pressure to obtain an aqueous solution of a component (A1) wherein the carboxyl groups of the copolymer had been neutralized.

Synthesis Example 2

A component (A2) was synthesized in the same manner as in the above Synthesis Example 1 except that a monomer composition shown in Table 2 was used.

Incidentally, "AB-6" used in Synthesis Example 2 is a macromonomer of a polybutyl acrylate having a methacryloyl group at one end [Macromonomer AB-6 (trade name), a product of Toagosei Co., Ltd. having a number-average molecular weight of 6,000]. The component (A2) obtained is a graft copolymer comprising a hydrophilic backbone composed of a MMA-AA copolymer and hydrophobic side chains composed of a polybutyl acrylate.

TABLE 2

| Synthesis Example | Symbol | Monomer composition of unneutralized copolymer (weight ratio) | Acid value (meq/g) | Tg (° C.) |
|---|---|---|---|---|
| 1 | A1 | MMA/ST/AA = 80/10/10 | 1.4 | 104.5 |
| 2 | A2 | AB-6/MMA/AA = 45/45/10 | 1.4 | 12.0 |

Synthesis Example 3

A component (A3) as a component (A) of the present invention was synthesized by the emulsion polymerization described below.

There were mixed 90 parts of MMA, 10 parts of AA (these are monomers) and 3 parts of octyl thioglycolate as a chain transfer agent to prepare a monomers mixture. To 100 parts of the monomer mixture were added 0.1 part of sodium lauryl sulfate as a polymerization emulsifier and 50 parts of deionized water. The resulting mixture was stirred for emulsification, to prepare a monomer emulsion.

30 parts of deionized water was fed into a flask provided with a stirrer, a condenser, a thermometer and a nitrogen-inlet tube. While the reactor inside was maintained at 70° C. in a nitrogen atmosphere, 8 parts of an aqueous APS solution (consisting of 2 parts of APS and 6 parts of deionized water) and 150 parts of the above-prepared monomer emulsion were drop-wise added to the reactor content in 3 hours. After the dropwise addition, the reaction system was maintained at the same temperature for 2 hours; thereafter, the reaction system was cooled to stop polymerization to obtain an aqueous polymer emulsion having a solid content of 50%. The polymer had an acid value of 1.4 meq/g.

Ammonia water was gradually added to the emulsion with stirring, to neutralize the carboxyl groups of the polymer (A3) and make the pH of the reaction mixture about 7 to 8, whereby an aqueous solution of a component (A3) was obtained.

[Synthesis of component (A4)]

A maleic anhydride-isobutylene block copolymer [Isoban 600 (trade name), a product of Kuraray Co., Ltd. having a molecular weight of 6,000 and an acid value of 6.5 meq/g] was neutralized by ammonia water to obtain an aqueous solution of a component (A4).

○ Synthesis of component (B)

Synthesis Example 4

In Synthesis Example 4, acrylic monomers were polymerized according to ordinary emulsion polymerization to synthesize a component (B1).

99 parts of BA and 1 part of HEMA were mixed to prepare a monomer mixture. 70 parts of deionized water and 0.2 part of sodium lauryl sulfate were fed into a flask provided with a stirrer, a condenser, a thermometer and a nitrogen-inlet tube. The flask content was heated to 60° C. in a nitrogen atmosphere. Thereto were dropwise added, in 3 hours, 5 parts of an aqueous solution of 10% of tert-butyl hydroperoxide, 5 parts of an aqueous solution of 10% of formaldehyde sodium sulfoxylate dihydrate [Rongalit C (trade name), hereinafter referred to simply as Rongalit, a product of Seitetsu Kagaku Kogyo K. K.] and 80 parts of the above-prepared monomer mixture. After the dropwise addition, the reaction system was maintained at the same temperature for 2 hours; thereafter, the reaction system was cooled to stop polymerization. The system was neutralized with ammonia water to make the pH of the system 7 to 8, whereby an aqueous polymer emulsion having a solid content of about 50% was obtained.

Synthesis Example 5

In Synthesis Example 5, a component (B2) which was an emulsion polymerizate of ethylene-vinyl ester type monomers, was synthesized in the following manner.

The inside of a temperature-controllable pressure reactor (an autoclave) provided with a stirrer was purged with nitrogen. Thereinto were fed 60 parts of deionized water, 0.2 part of sodium lauryl sulfate, 0.5 part of hydroxyethyl cellulose, 0.06 part of sodium acetate and 0.6 part of Rongalit.

The inside of the reactor was heated to 55° C.; then, EL was added and the pressure inside the reactor was adjusted to 60 kg/cm$^2$. Thereto were dropwise added, in 5 hours, a monomer mixture consisting of 20 parts of VAC and 60 parts of HA and 40 parts of an aqueous solution of 10% of APS. After the dropwise addition, the reactor content was maintained at the same temperature for 2 hours, after which the reaction system was cooled to stop polymerization. The system was neutralized with ammonia water to make the pH of the system 7 to 8, whereby an emulsion composed of a copolymer (B2) was obtained. The emulsion had a solid content of 50% and the copolymer (B2) had a monomer composition as shown in Table 3.

TABLE 3

| Synthesis Example | Symbol | Monomer composition (weight ratio) | Tg (° C.) | Acid value (meq/g) |
|---|---|---|---|---|
| 4 | B1 | BA/HEMA = 99/1 | −53.3 | 0 |
| 5 | B2 | BL/VAC/HA = 20/20/60 | −71.7 | 0 |

○ Production of Pressure-sensitive Adhesive Compositions

Example 1

99 parts of BA and 1 part of HEMA were mixed to prepare a monomer mixture. 70 parts of deionized water and 40 parts (20 parts as solid content) of the aqueous solution of the component (A1), obtained in Synthesis Example 1 were fed into a flask provided with a stirrer, a condenser, a thermometer and a nitrogen-inlet tube. The flask content was heated to 60° C. in a nitrogen atmosphere. Thereto were dropwise added, in 3 hours, 5 parts of an aqueous solution of 10% of tertbutyl hydroperoxide, 5 parts of an aqueous solution of 10% of Rongalit and 80 parts of the above-prepared monomer mixture. After the dropwise addition, the reaction system was maintained at the same temperature for 2 hours; thereafter, the reaction system was cooled to stop polymerization. The system was neutralized with ammonia water to make the pH of the system 7 to 8, whereby a pressure-sensitive adhesive composition consisting of an aqueous polymer emulsion having a solid content of about 50% was obtained.

Examples 2 to 4

Aqueous polymer emulsions were obtained in the same manner as in Example 1 except that the component (A) shown in Table 4 was used in place of the component (A1) used in Example 1.

TABLE 4

| Example | Component (A) symbol | Component (B) Monomer composition (weight ratio) | Component (B) Tg (° C.) | Component (B) Acid value (meq/g) | Solid content ratio (A/B) |
|---|---|---|---|---|---|
| 1 | A1 | BA/HEMA = 99/1 | −53.3 | 0 | 20/80 |
| 2 | A2 | BA/HEMA = 99/1 | −53.3 | 0 | 20/80 |
| 3 | A3 | BA/HEMA = 99/1 | −53.3 | 0 | 20/80 |
| 4 | A4 | BA/MAA = 99/1 | −53.0 | 0.12 | 20/80 |

Examples 5 to 6

Pressure-sensitive adhesive compositions of aqueous emulsion type were synthesized by mixing the component (A) and the component (B) both obtained in the above Synthesis Examples, at the solid content ratio shown in Table 5.

TABLE 5

| Example | Component (A) Kind | Component (A) Amount of copolymer | Component (B) Kind | Component (B) Amount of copolymer |
|---|---|---|---|---|
| 5 | A2 | 30 | B1 | 70 |
| 6 | A2 | 20 | B2 | 80 |

COMPARATIVE EXAMPLE 1

A copolymer of monomer composition of BA/MAA=99/1 was obtained by copolymerizing BA and MAA by the same emulsion polymerization as used in Synthesis Example 4. The copolymer was used as a pressure-sensitive adhesive.

The copolymer had a Tg of −53° C. and an acid value of 0.12.

COMPARATIVE EXAMPLE 2

A copolymer of monomer composition of BA/MAA=90/10 was obtained by copolymerizing BA and MAA by the same emulsion polymerization as used in Synthesis Example 4. The copolymer was used as a pressure-sensitive adhesive.

The copolymer had a Tg of −43.5° C. and an acid value of 1.16.

COMPARATIVE EXAMPLE 3

A commercial ethylene-based aqueous emulsion [SUMIKAFLEX EVA-921 (trade name), a product of Sumitomo Chemical Co., Ltd. having a solid content of 60% by weight and a Tg of −40° C.] was used as a pressure-sensitive adhesive.

○ Evaluation of Pressure-sensitive Adhesive Compositions

A pressure-sensitive adhesive sheet prepared using one of the pressure-sensitive adhesive compositions obtained in Examples 1 to 6 and Comparative Examples 1 to 3 was attached to the following article according to the following procedure. The obtained article with a pressure-sensitive adhesive sheet was measured for the following properties as follows. The results are shown in Table 6.

(1) Adhesive Strength of Pressure-sensitive Adhesive sheet

A coated paper for a label was used as a base material. Thereon was coated a pressure-sensitive adhesive composition so that the thickness of the resulting film after drying became 20 to 30 μm. The resulting paper was dried at 40° C. for 5 minutes to prepare a pressure-sensitive adhesive sheet.

The pressure-sensitive adhesive sheet was cut to obtain a test piece of 25 mm (width) and about 250 mm (length) (hereinafter this test piece is referred to as "test piece before heat treatment"). There was also obtained a heat-treated test piece (this test piece is hereinafter referred to as "test piece after heat treatment") by subjecting the test piece before heat treatment to a heat treatment at 140° C. for 2 minutes and then allowing the resulting test piece to stand for 24 hours in an atmosphere of a temperature of 23° C. and a humidity of 65%. Both the test piece before heat treatment and the test piece after heat treatment were measured for adhesive strength by the 180° peeling method specified by JIS Z 0237.

That is, under the condition of 23° C. (temperature) and 65% (humidity), each of the above-obtained test pieces was attached onto a polished stainless steel plate as an article, and a 2-kg rubber roller was shuttled once on the test piece to bond the test piece to the article. 30 minutes after the bonding, the adhesive strength of the test piece was measured at a tensile speed of 300 mm/min by the 180° peeling method. The results of measurement were expressed according to the following four levels.

A: 500 g/25 mm or more

B: 100 g/25 mm to less than 500 g/25 mm

C: more than 10 g/25 mm to less than 100 g/25 mm

D: 10 g/25 mm or less (2) Water Resistance

Each of the pressure-sensitive adhesive sheets obtained in the same manner as in the above test for adhesive strength was cut into a size of 80 mm (width) and about 100 mm (length) and then subjected to a heat treatment at 140° C. for 2 minutes to obtain a test piece (a test piece after heat treatment). The test piece was attached to the side of a bottle for beer as an article, and a 2-kg rubber roller was shuttled once on the test piece to bond the test piece to the bottle. 2 days after the bonding, the bottle was immersed in water of 10° C. and the condition of peeling of the test piece was observed. The results of observation were expressed according to the following three levels. Incidentally, in this test, "peeling" refers to a state in which at least a part of the test piece is peeled from the bottle for beer as an article.

○: No peeling even after 60 hours.

Δ: Peeling appeared after 20 hours to less than 60 hours.

x: Peeling appeared in less than 20 hours.

(3) Alkali peelability

Each test piece (test piece after heat treatment) prepared in the same size and the same manner as in the above test for water resistance was attached to the side of a bottle for beer as an article, and a 2-kg rubber roller was shuttled once on the test piece to bond the test piece to the bottle. 2 days after the bonding, the bottle was immersed in a 3 wt. % aqueous sodium hydroxide solution of 70° C. and the condition of peeling of the test piece was observed. The results of observation were expressed according to the following three levels.

○: the test piece peeled off in less than 2 minutes.

Δ: the test piece peeled off after 2 minutes to less than 6 minutes.

x: the test piece showed no peeling even after 6 minutes.

TABLE 6

| | Adhesive strength (g/25 mm) | | | Alkali |
|---|---|---|---|---|
| | Before heating | After heating | Water resistance | peel-ability |
| Example 1 | D | A | ○ | ○ |
| Example 2 | D | A | ○ | ○ |
| Example 3 | D | A | ○ | ○ |
| Example 4 | D | B | Δ | ○ |
| Example 5 | D | A | ○ | ○ |
| Example 6 | D | B | ○ | ○ |
| Comparative Example 1 | A | A | Δ | x |
| Comparative Example 2 | B | B | x | ○ |
| Comparative Example 3 | A | A | ○ | x |

Thus, in the article with a label, obtained by the present invention, the label can be easily peeled by washing with an aqueous alkali solution; the adhesive strength between the label and the article is high; and the adhesive layer has excellent water resistance. Further in the present invention, since a heat-sensitive pressure-sensitive adhesive is used, an operation of peeling a release paper or the like from a pressure-sensitive adhesive label is unnecessary at the time of attaching the label onto an article. Therefore, in the present invention, a label can be efficiently attached to an article.

INDUSTRIAL APPLICABILITY

The present invention is useful as a process for producing an article with a label, which article comprises an adhered and a pressure-sensitive adhesive label attached thereto and in which article the pressure-sensitive adhesive label can be easily peeled from the adhered by contacting the bonded area between the adhered and the label with an aqueous alkali solution.

What is claimed is:

1. A process for producing an article with a label, which comprises attaching, to an article, a heat-sensitive and pressure-sensitive adhesive label having an adhesive layer composed of a pressure-sensitive adhesive composition, which is an aqueous emulsion type composition comprising:

(A) a water-soluble resin obtained by neutralizing a resin having an acid value of 1 meq/g or more, with a base, and (B) a polymer having an acid value of 0.6 meq/g or less and a glass transition temperature of −20° C. or lower, obtained by emulsion polymerization of a radical-polymerizable monomer, and which, when made into an aqueous film and dried at a temperature lower than 60° C., becomes a film (1) of two-phase structure wherein particles composed of the component (B) are dispersed in a continuous phase composed of the component (A) and, when the film (1) is heated to a temperature of 60° C. or higher, is converted into a pressure-sensitive adhesive film (2) wherein the forms of the component (A) and the component (B) in the above two-phase structure are reversed and particles of the component (A) are dispersed in a continuous phase of the component (B).

2. A process for producing an article with a label according to claim 1, wherein the pressure-sensitive adhesive composition satisfies a requirement that the film (1) has a surface adhesive strength of 10 g/25 mm or less as measured at 23° C. by the 180° peeling method specified by JIS Z 0237 and the film (2) has a surface adhesive strength of 100 g/25 mm or more as measured by the same method.

3. A process for producing an article with a label according to claim 1, wherein the resin used in production of the component (A), before neutralization is a copolymer composed of an α,β-ethylenically unsaturated carboxylic acid monomer unit and a hydrophobic radical-polymerizable monomer unit.

4. A process for producing an article with a label according to claim 2, wherein the resin used in production of the component (A), before neutralization, is a copolymer composed of an α,β-ethylenically unsaturated carboxylic acid monomer unit and a hydrophobic radical-polymerizable monomer unit.

* * * * *